US010235935B2

(12) United States Patent
Tsuge

(10) Patent No.: US 10,235,935 B2
(45) Date of Patent: Mar. 19, 2019

(54) POWER OFF METHOD OF DISPLAY DEVICE, AND DISPLAY DEVICE

(71) Applicant: JOLED INC., Tokyo (JP)

(72) Inventor: Hitoshi Tsuge, Tokyo (JP)

(73) Assignee: JOLED INC., Tokyo (JP)

( * ) Notice: Subject to any disclaimer, the term of this patent is extended or adjusted under 35 U.S.C. 154(b) by 82 days.

(21) Appl. No.: 15/032,147

(22) PCT Filed: Jul. 23, 2014

(86) PCT No.: PCT/JP2014/003886
§ 371 (c)(1),
(2) Date: Apr. 26, 2016

(87) PCT Pub. No.: WO2015/063980
PCT Pub. Date: May 7, 2015

(65) Prior Publication Data

US 2016/0260378 A1 Sep. 8, 2016

(30) Foreign Application Priority Data

Oct. 30, 2013 (JP) ..... 2013-226006

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/0251* (2013.01); *G09G 2330/02* (2013.01); *G09G 2330/027* (2013.01)

(58) Field of Classification Search
CPC ... G09G 2300/0819; G09G 2300/0842; G09G 2300/0861; G09G 2310/0251; G09G 2330/02; G09G 2330/027; G09G 3/3233
See application file for complete search history.

(56) References Cited

U.S. PATENT DOCUMENTS 8,159,489 B2 4/2012 Nakamura et al.
8,228,271 B2 7/2012 Hirai et al.
8,299,984 B2 10/2012 Nathan et al.
9,214,107 B2 12/2015 Fish et al.
9,647,047 B2 * 5/2017 Jeong ..... H01L 27/3262
(Continued)

FOREIGN PATENT DOCUMENTS

JP 2007-504501 3/2007
JP 2009-104104 5/2009
(Continued)

OTHER PUBLICATIONS

English Translation and Drawings for JP 2011-221165.*
(Continued)

*Primary Examiner* — Patrick N Edouard
*Assistant Examiner* — Eboni N Hughes
(74) *Attorney, Agent, or Firm* — Greenblum & Bernstein, P.L.C.

(57) ABSTRACT

A power off method of a display device includes: detecting a power off operation on the display device; setting, when the power off operation is detected, a voltage for suppressing electrical stress on a drive transistor, in a capacitance element in each of a plurality of pixel circuits; and stopping power supply to a display panel immediately after the voltage is set.

4 Claims, 11 Drawing Sheets

(56) References Cited

U.S. PATENT DOCUMENTS

| | | | | |
|---|---|---|---|---|
| 2003/0218593 | A1* | 11/2003 | Inoue | G09G 3/3655 345/92 |
| 2005/0083270 | A1* | 4/2005 | Miyazawa | G09G 3/3233 345/76 |
| 2006/0256048 | A1 | 11/2006 | Fish et al. | |
| 2007/0273618 | A1* | 11/2007 | Hsieh | G09G 3/3233 345/76 |
| 2009/0135110 | A1 | 5/2009 | Nakamura et al. | |
| 2009/0262101 | A1 | 10/2009 | Nathan et al. | |
| 2009/0309824 | A1* | 12/2009 | Kwon | G09G 3/3677 345/98 |
| 2010/0073265 | A1 | 3/2010 | Hirai et al. | |
| 2013/0241431 | A1 | 9/2013 | Toyotaka et al. | |
| 2014/0085176 | A1* | 3/2014 | Kang | G09G 3/3677 345/100 |
| 2014/0092144 | A1* | 4/2014 | Kim | G09G 3/3233 345/690 |
| 2014/0176516 | A1* | 6/2014 | Kim | G09G 3/3233 345/204 |
| 2015/0145845 | A1* | 5/2015 | Nam | G09G 3/3233 345/209 |
| 2016/0063955 | A1* | 3/2016 | Yamamoto | H03K 3/356026 345/205 |
| 2016/0267845 | A1* | 9/2016 | Tsuge | G09G 3/3233 |
| 2016/0307505 | A1* | 10/2016 | Tsuge | G09G 3/3233 |

FOREIGN PATENT DOCUMENTS

| | | |
|---|---|---|
| JP | 2009-128601 | 6/2009 |
| JP | 2009-271333 | 11/2009 |
| JP | 2011-118086 | 6/2011 |
| JP | 2011-520138 | 7/2011 |
| JP | 2011-221165 | 11/2011 |
| WO | 2005/022498 | 3/2005 |
| WO | 2009/127064 | 10/2009 |
| WO | 2013/137014 | 9/2013 |

OTHER PUBLICATIONS

International Search Report in International Patent Application No. PCT/JP2014/003886, dated Oct. 28, 2014.

U.S. Appl. No. 15/032,133 to Hitoshi Tsuge, filed Apr. 26, 2016.

* cited by examiner

POWER OFF METHOD OF DISPLAY DEVICE, AND DISPLAY DEVICE

TECHNICAL FIELD

The disclosure relates to a power off method of a display device and to a display device. The disclosure particularly relates to a power off method of a display device that uses light emitting elements which emit light according to current, and to such a display device.

BACKGROUND ART

Organic EL displays utilizing organic electroluminescence (EL) have attracted attention in recent years, as a next-generation flat panel display to replace liquid crystal displays. Active matrix display devices such as organic EL displays use thin film transistors (TFTs) as drive transistors.

CITATION LIST

Patent Literature

[PTL 1]
Japanese Unexamined Patent Application Publication No. 2009-104104

SUMMARY OF INVENTION

Technical Problem

Patent Literature (PTL) 1 describes temporal characteristics shifts associated with thin film transistors. In an oxide thin film transistor, the threshold voltage (gate-source voltage upon a transition between on and off) tends to shift due to electrical stress by the passage of current or the like. Such a temporal shift of the threshold voltage causes the amount of current supplied to an organic EL light emitting element to vary, thus affecting the luminance control of the display device and creating a problem of display quality degradation.

In view of the problem stated above, the disclosure provides a power off method of a display device and a display device that can prevent the threshold voltage shift of each drive transistor.

Solution to Problem

To solve the stated problem, a power off method of a display device according to the disclosure is a power off method of a display device that includes a display panel having a plurality of pixel circuits arranged in a matrix. Each of the plurality of pixel circuits includes: a light emitting element that emits light with luminance corresponding to an amount of current supplied; a drive transistor that supplies the current to the light emitting element; and a capacitance element that is connected to a gate of the drive transistor and holds a voltage representing the luminance. The power off method of a display device includes: detecting a power off operation on the display device; setting, when the power off operation is detected, a voltage for suppressing electrical stress on the drive transistor, in the capacitance element in each of the plurality of pixel circuits; and stopping power supply to the display panel immediately after the voltage is set, wherein in the setting, a voltage equivalent to a threshold voltage of the drive transistor is set in the capacitance element in each of the plurality of pixel circuits.

A display device according to the disclosure is a display device including a display panel having a plurality of pixel circuits arranged in a matrix. Each of the plurality of pixel circuits includes: a light emitting element that emits light according to an amount of current supplied; a drive transistor that supplies the current to the light emitting element; and a capacitance element that is connected to a gate of the drive transistor and holds a voltage representing luminance. The display device includes: a control unit that sets, when a power off operation is detected, a voltage for suppressing electrical stress on the drive transistor, in the capacitance element in each of the plurality of pixel circuits; and a power unit that stops power supply to the display panel immediately after the control unit sets the voltage, wherein the control unit sets a voltage equivalent to a threshold voltage of the drive transistor, as the voltage for suppressing electrical stress on the drive transistor.

Advantageous Effects of Invention

With the power off method of a display device and the display device according to the disclosure, the threshold voltage shift of each drive transistor in the period during which the power of the display device is off can be prevented.

DESCRIPTION OF EMBODIMENTS

Figure 1:
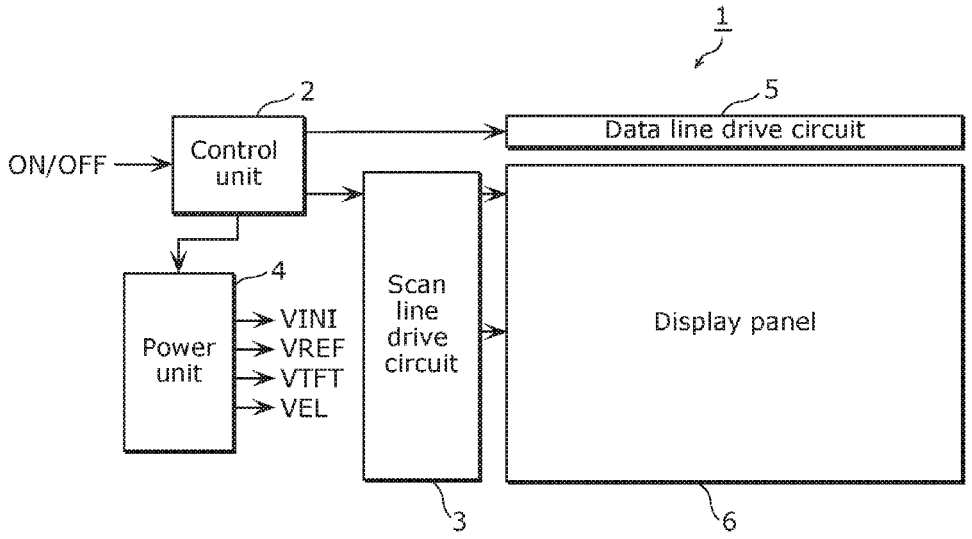
FIG. 1 is a block diagram illustrating an example of the structure of a display device according to an embodiment.

Underlying Knowledge Forming Basis of the Disclosure

Before the detailed description of the disclosed technique, underlying knowledge forming the basis of the disclosure is explained below.

Typically, a thin film transistor has high electron mobility, and is used as a drive transistor in each pixel of an active matrix display device. Each pixel of the display device includes a capacitance element that holds a voltage representing luminance, and the capacitance element is connected to the gate of the drive transistor. When the voltage representing luminance is applied to the gate of the drive transistor, the drive transistor supplies the current corresponding to the luminance value to an organic EL element (light emitting element). When supplied with the current, the light emitting element emits the amount of light corresponding to the current value.

An oxide thin film transistor used as such a drive transistor is advantageous in that it has very low leakage current during power off, and the magnitude of the leakage current is of the order of pA.

The inventors of the present application have found the following problem with regard to this very low leakage current. Since the leakage current is very low, even after the display device is powered off, the voltage representing the luminance immediately before the power off may be held in each pixel for several days, and applied to the drive transistor. This puts electrical stress on the drive transistor for several days despite the power of the display device being off, and causes its threshold voltage to shift.

There is thus a problem in that the threshold voltage of the drive transistor shifts even when the power of the organic EL display device is off. The threshold voltage shift differs depending on the type of oxide thin film transistor. For example, when the positive bias stress between the gate and the source is greater, the threshold voltage shifts more to the positive side.

Since the threshold voltage shifts differently depending on the display pattern immediately before power off, variations in threshold voltage shift amount among different pixels increase, which degrades image quality.

Based on such knowledge, a power off method of a display device according to the disclosure sets, when a power off operation on the display device is detected, a voltage for suppressing electrical stress on a drive transistor, and stops power supply to the display panel immediately after the voltage is set. The voltage for suppressing electrical stress is actually the voltage equivalent to the threshold voltage of the drive transistor. In a state where the voltage equivalent to the threshold voltage is applied to the gate of the drive transistor, the electric field of the drive transistor is balanced stably, so that electrical stress is substantially suppressed. In addition, variations in drive transistor threshold voltage shift among pixels are suppressed.

In this way, electrical stress on the drive transistor is suppressed during power off of the display device, with it being possible to prevent the threshold voltage shift of the drive transistor.

The following describes embodiments in detail with reference to drawings.

Each of the embodiments described below shows a general or specific example. The numerical values, shapes, materials, structural elements, the arrangement and connection of the structural elements, steps, the processing order of the steps etc. shown in the following embodiments are mere examples, and do not limit the scope of the disclosure. Of the structural elements in the embodiments described below, the structural elements not recited in any one of the independent claims representing the broadest concepts are described as optional structural elements.

Embodiment

A power off method of a display device and a display device according to the disclosure are described below, with reference to drawings.

[1-1. Structure of Display Device]

Figure 2:
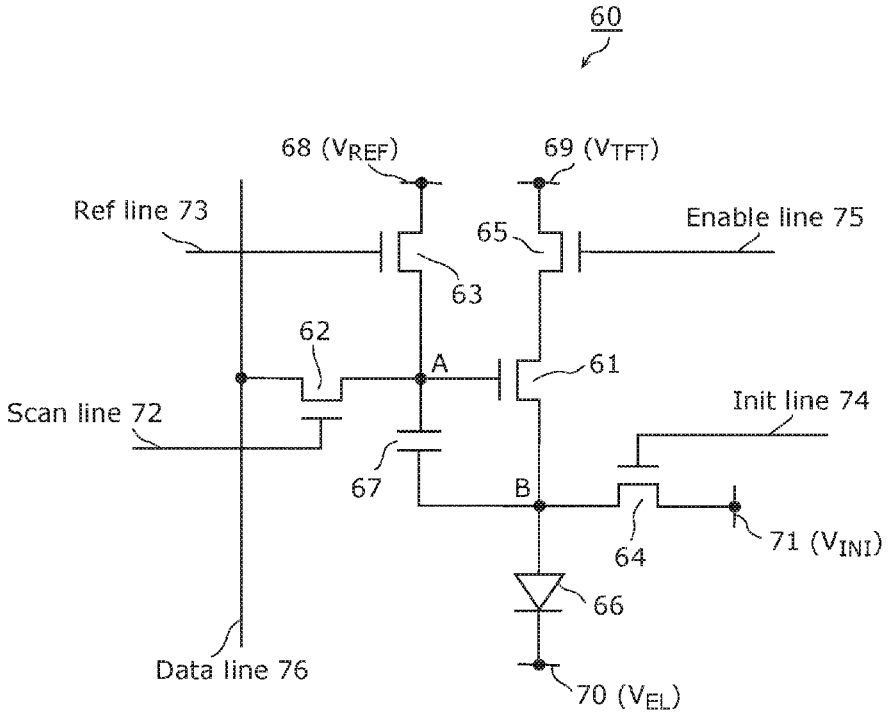
FIG. 2 is a circuit diagram illustrating an example of the structure of one of a plurality of pixel circuits arranged two-dimensionally in the display panel in FIG. 1 according to the embodiment.

This embodiment describes the case where organic EL elements are used as light emitting elements in a display device according to an aspect of the disclosure, with reference to FIGS. 1 and 2.

FIG. 1 is a block diagram illustrating an example of the structure of the display device according to the embodiment. FIG. 2 is a circuit diagram illustrating an example of the structure of one of a plurality of pixel circuits arranged two-dimensionally in the display panel in FIG. 1.

A display device 1 in FIG. 1 includes a control unit 2, a scan line drive circuit 3, a power unit 4, a data line drive circuit 5, and a display panel 6.

The display panel 6 is, for example, an organic EL panel. The display panel 6 includes N (e.g. N=1080) scan lines and N lighting control lines in parallel with each other, and M source signal lines orthogonal to the N scan lines and N lighting control lines. The display panel 6 also includes pixel circuits each including a thin film transistor and an EL element, at the respective intersections of the source signal lines and scan lines. Pixel circuits corresponding to the same scan line are hereafter referred to as "display line" according to need. In other words, N display lines each of which has M EL elements are arranged in the display panel 6.

The control unit 2 controls the frame-by-frame operation in normal display when the power of the display device is on, and controls the off sequence operation when a power off operation is detected. One of the features of the disclosure is that, when a power off operation on the display device is detected, the control unit 2 shifts control from the normal display operation to the off sequence operation. In the off sequence, the control unit 2 sets a voltage for suppressing electrical stress on the drive transistor in each pixel circuit, and controls the power unit 4 to stop power supply to the display panel 6 immediately after the voltage is set.

In the normal display, the control unit 2 generates a first control signal for controlling the data line drive circuit 5 based on a display data signal, and outputs the generated first control signal to the data line drive circuit 5. The control unit 2 also generates a second control signal for controlling the scan line drive circuit 3 based on an input synchronization signal, and outputs the generated second control signal to the scan line drive circuit 3.

The display data signal mentioned here represents display data, and includes a video signal, a vertical synchronization signal, and a horizontal synchronization signal. The video signal is a signal for designating each pixel value as gray level information, for each frame. The vertical synchronization signal is a signal for synchronizing vertical screen processing, and serves here as a reference signal for processing timing of each frame. The horizontal synchronization signal is a signal for synchronizing horizontal screen processing, and serves here as a reference signal for processing timing of each display line.

The first control signal includes the video signal and the horizontal synchronization signal. The second control signal includes the vertical synchronization signal and the horizontal synchronization signal.

The power unit 4 supplies power to each of the control unit 2, the scan line drive circuit 3, and the display panel 6, and also supplies various voltages to the display panel 6. The various voltages are $V_{INI}$, $V_{REF}$, $V_{TFT}$, and $V_{EL}$ in the pixel circuit example in FIG. 2, which are supplied to each pixel circuit respectively via an initialization power line 71, a reference voltage power line 68, an EL anode power line 69, and an EL cathode power line 70.

The data line drive circuit 5 drives each source signal line (data line 76 in FIG. 2) in the display panel 6, based on the first control signal generated by the control unit 2. In more detail, the data line drive circuit 5 outputs a source signal to each pixel circuit based on the video signal and the horizontal synchronization signal.

The scan line drive circuit 3 drives each scan line in the display panel 6, based on the second control signal generated by the control unit 2. In more detail, the scan line drive circuit 3 outputs a scan signal, a ref signal, an enable signal, and an init signal to each pixel circuit at least on a display line basis, based on the vertical synchronization signal and the horizontal synchronization signal. These scan signal, ref signal, enable signal, and init signal are output respectively to a scan line 72, a ref line 73, an enable line 75, and an init line 74 in the pixel circuit example in FIG. 2, and are each used to control on/off of the connected switch.

The display device 1 has the structure described above.

The display device 1 may include, for example, a central processing unit (CPU), a storage medium such as read only memory (ROM) storing a control program, working memory such as random access memory (RAM), and a communication circuit, although not illustrated. For example, a display data signal S1 is generated by the CPU executing the control program.

The structure of the pixel circuit illustrated as an example in FIG. 2 is described next.

A pixel circuit 60 in FIG. 2 is one pixel included in the display panel 6, and has a function of emitting the amount of light corresponding to the data signal (data signal voltage) supplied via the data line 76 (data line).

The pixel circuit 60 is an example of one of the display pixels (light emitting pixels) arranged in a matrix. The pixel circuit 60 includes a drive transistor 61, a switch 62, a switch 63, a switch 64, an enable switch 65, an EL element 66, and a capacitance element 67. The pixel circuit 60 also includes the data line 76 (data line), the reference voltage power line 68 ($V_{REF}$), the EL anode power line 69 ($V_{TFT}$), the EL cathode power line 70 ($V_{EL}$), and the initialization power line 71 ($V_{INI}$).

The data line 76 is an example of the signal line (source signal line) for supplying the data signal voltage.

The reference voltage power line 68 ($V_{REF}$) is a power line for supplying the reference voltage $V_{REF}$ that defines the voltage value of a first electrode of the capacitance element 67. The EL anode power line 69 ($V_{TFT}$) is a high-voltage power line for determining the potential of the drain electrode of the drive transistor 61. The EL cathode power line 70 ($V_{EL}$) is a low-voltage power line connected to a second electrode (cathode) of the EL element 66. The initialization power line 71 ($V_{INI}$) is a power line for initializing the source-gate voltage of the drive transistor 61, i.e. the voltage of the capacitance element 67.

The EL element 66 is an example of one of the light emitting elements arranged in a matrix. The EL element 66 has a light emission period in which the EL element 66 emits light with a drive current passing through it, and a non-light emission period in which the EL element 66 does not emit light with no drive current passing through it. In detail, the EL element 66 emits the amount of light corresponding to the amount of current supplied from the drive transistor 61. The EL element 66 is, for example, an organic EL element. The EL element 66 has its cathode (second electrode) connected to the EL cathode power line 70, and its anode (first electrode) connected to the source (source electrode) of the drive transistor 61. The voltage supplied to the EL cathode power line 70 here is $V_{EL}$, which is 0 V as an example.

The drive transistor 61 is a voltage drive element for controlling the amount of current supplied to the EL element 66, and causes the EL element 66 to emit light by passing a current (drive current) through the EL element 66. In detail, the drive transistor 61 has its gate electrode connected to the first electrode of the capacitance element 67, and its source electrode connected to the second electrode of the capacitance element 67 and the anode of the EL element 66.

In the case where the switch 63 is off (nonconducting state) so that the reference voltage power line 68 and the first electrode of the capacitance element 67 are not in conduction with each other and the enable switch 65 is on (conducting state) so that the EL anode power line 69 and the drain electrode are in conduction with each other, the drive transistor 61 passes the drive current corresponding to the data signal voltage through the EL element 66, to cause the EL element 66 to emit light. The voltage supplied to the EL anode power line 69 here is $V_{TFT}$, which is 20 V as an example. Thus, the drive transistor 61 converts the data signal voltage (data signal) supplied to the gate electrode into the signal current corresponding to the data signal voltage (data signal), and supplies the signal current to the EL element 66.

In the case where the switch 63 is off (nonconducting state) so that the reference voltage power line 68 and the first electrode of the capacitance element 67 are not in conduction with each other and the enable switch 65 is off (nonconducting state) so that the EL anode power line 69 and the drain electrode are not in conduction with each other, the drive transistor 61 passes no drive current through the EL element 66, to cause the EL element 66 not to emit light.

The threshold voltage of the drive transistor 61 may vary among pixel circuits, due to a temporal shift of the threshold voltage. The effect of such variations can be suppressed by a threshold voltage compensation operation and a threshold setting operation. In brief, the threshold compensation operation and the threshold setting operation are each an operation of setting, in the capacitance element 67 in each pixel circuit, the voltage equivalent to the threshold voltage of the corresponding drive transistor 61. This operation will be described in detail later.

The capacitance element 67 is an example of a storage capacitor for holding a voltage, and holds the voltage that determines the amount of current passed by the drive transistor 61. In detail, the capacitance element 67 has its second electrode (electrode on the node B side) connected between the source (on the EL cathode power line 70 side) of the drive transistor 61 and the anode (first electrode) of the EL element 66, and its first electrode (electrode on the node A side) connected to the gate of the drive transistor 61.

The first electrode of the capacitance element 67 is also connected to the reference voltage power line 68 ($V_{REF}$) via the switch 63.

The switch 62 switches the state between the data line 76 (signal line) for supplying the data signal voltage and the first electrode of the capacitance element 67, between conducting and nonconducting. In detail, the switch 62 is a switching transistor that has one of its drain and source terminals connected to the data line 76, the other one of its drain and source terminals connected to the first electrode of the capacitance element 67, and its gate connected to the scan line 72 as a scan line. In other words, the switch 62 has a function of writing the data signal voltage (data signal) corresponding to the video signal voltage (video signal) supplied via the data line 76, to the capacitance element 67.

The switch 63 switches the state between the reference voltage power line 68 for supplying the reference voltage $V_{REF}$ and the first electrode of the capacitance element 67, between conducting and nonconducting. In detail, the switch 63 is a switching transistor that has one of its drain and source terminals connected to the reference voltage power line 68 ($V_{REF}$), the other one of its drain and source terminals connected to the first electrode of the capacitance element 67, and its gate connected to the ref line 73. In other words, the switch 63 has a function of supplying the reference voltage ($V_{REF}$) to the first electrode of the capacitance element 67 (the gate of the drive transistor 61).

The switch 64 switches the state between the second electrode of the capacitance element 67 and the initialization power line 71, between conducting and nonconducting. In detail, the switch 64 is a switching transistor that has one of its drain and source terminals connected to the initialization power line 71 ($V_{INI}$), the other one of its drain and source terminals connected to the second electrode of the capacitance element 67, and its gate connected to the init line 74. In other words, the switch 64 has a function of supplying the initialization voltage ($V_{INI}$) to the second electrode of the capacitance element 67 (the source of the drive transistor 61).

The enable switch 65 switches the state between the EL anode power line 69 and the drain electrode of the drive transistor 61, between conducting and nonconducting. In detail, the enable switch 65 is a switching transistor that has one of its drain and source terminals connected to the EL anode power line 69 ($V_{TFT}$), the other one of its drain and source terminals connected to the drain electrode of the drive transistor 61, and its gate connected to the enable line 75.

The pixel circuit 60 has the structure described above.

Although the following description assumes that the switches 62 to 64 and the enable switch 65 in the pixel circuit 60 are n-type TFTs, this is not a limitation. The switches 62 to 64 and the enable switch 65 may be p-type TFTs. Alternatively, the switches 62 to 64 and the enable switch 65 may be a combination of n-type and p-type TFTs. Any signal line connected to the gate of a p-type TFT has the below-mentioned voltage level inverted.

The potential difference between the voltage $V_{REF}$ of the reference voltage power line 68 and the voltage $V_{INI}$ of the initialization power line 71 is set to be larger than the maximum threshold voltage of the drive transistor 61.

Moreover, the voltage $V_{REF}$ of the reference voltage power line 68 and the voltage $V_{INI}$ of the initialization power line 71 are set as follows so that no current flows through the EL element 66.

(voltage $V_{INI}$)<(voltage $V_{EL}$)+(the forward current threshold voltage of the EL element 66)

(the voltage $V_{REF}$ of the reference voltage power line 68)<(voltage $V_{EL}$)+(the forward current threshold voltage of the EL element 66)+(the threshold voltage of the drive transistor 61).

Here, the voltage $V_{EL}$ is the voltage of the EL cathode power line 70 as mentioned above.

[1-2. Operation of Display Device]

Figure 3:
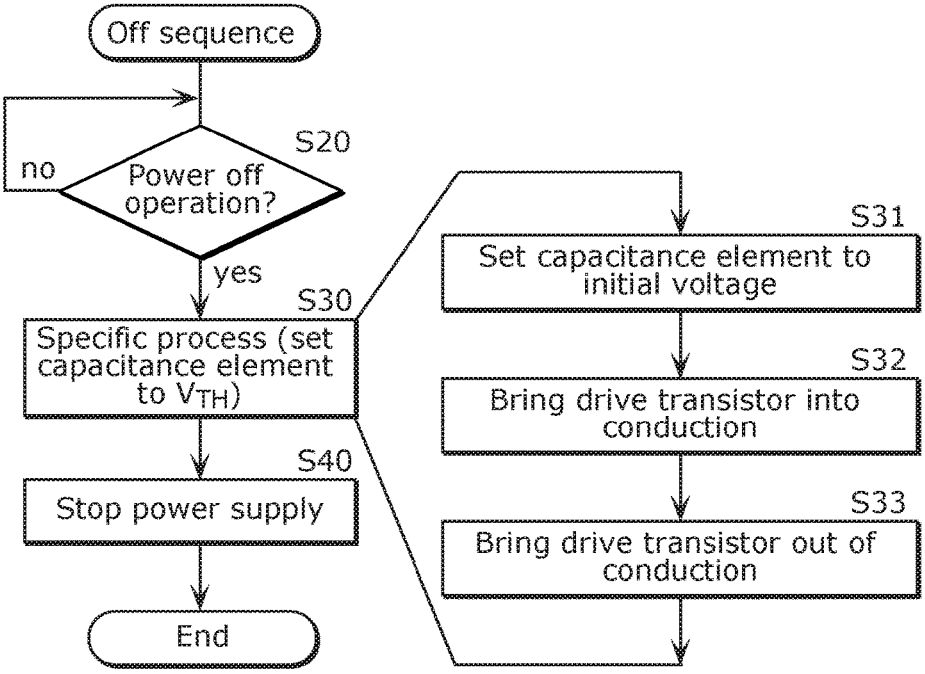
FIG. 3 is a flowchart illustrating the power off method of the display device according to the embodiment.
Figure 4:
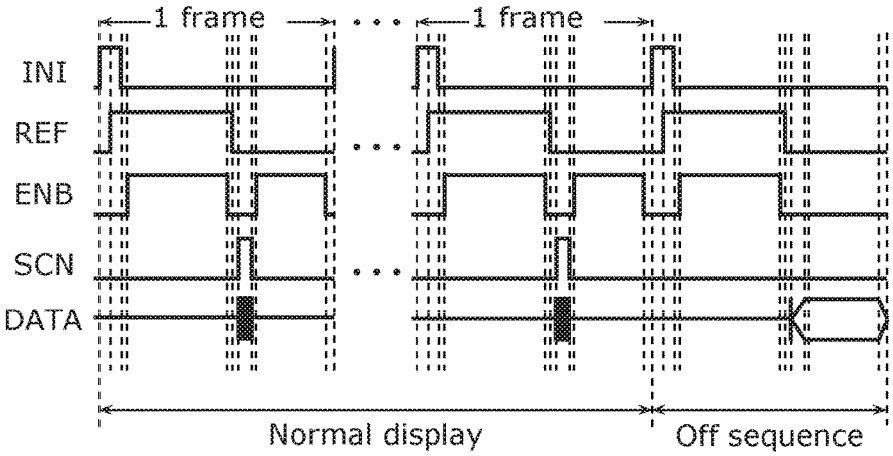
FIG. 4 is a timing chart illustrating the normal display operation and the off sequence performed immediately before power off of the display device according to the embodiment.
Figure 5:
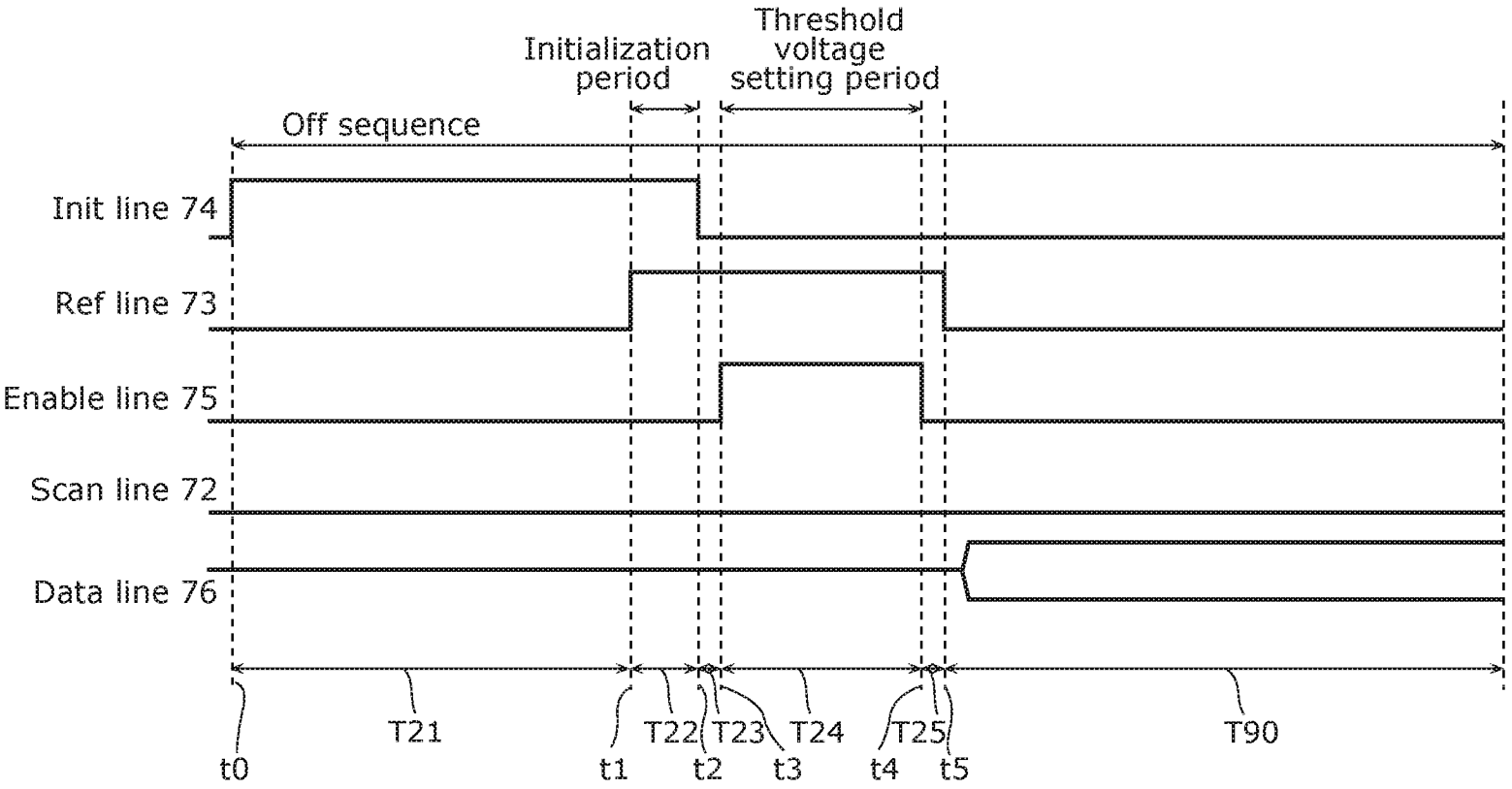
FIG. 5 is a timing chart illustrating an example of the detailed timings of the off sequence in FIG. 4.

The following describes the operation in the example of the structure of the display device illustrated in FIGS. 1 and 2, with reference to FIGS. 3 to 5.

FIG. 3 is a flowchart illustrating the power off method of the display device according to the embodiment. FIG. 4 is a timing chart illustrating the normal display operation and the off sequence performed immediately before power off of the display device according to the embodiment. FIG. 5 is a timing chart illustrating an example of the detailed timings of the off sequence in FIG. 4.

The off sequence operation (power off method) is described first, before the description of the normal display operation.

As illustrated in FIG. 3, the control unit 2 detects a power off operation on the display device 1 (Step S20). Examples of the power off operation include: the user pressing a power button on a remote control; the user pressing a power button on the body of the display device 1; the arrival of an off time of an off timer set by the user; a lapse of a time of a non-operation duration measurement timer set by the user; and a decrease in AC power voltage when power fails. When the power off operation is detected, the operation of the control unit 2 shifts from normal display control to off sequence control, as illustrated in FIG. 4.

When the power off operation is detected, the control unit 2 performs a specific process, namely, setting, in the capacitance element 67 in each of the plurality of pixel circuits 60, a voltage for suppressing electrical stress on the drive transistor 61 (Step S30). The voltage for suppressing electrical stress is actually the voltage equivalent to the threshold voltage of the drive transistor, as mentioned above. In a state where the voltage equivalent to the threshold voltage is applied to the gate of the drive transistor, the electric field of the drive transistor is balanced stably, so that electrical stress is substantially suppressed.

Further, the power unit 4 stops power supply to the display panel 6, the scan line drive circuit 3, and the data line drive circuit 5 immediately after the voltage is set, under control by the control unit 2 (Step S40). This puts the display device 1 in a power off state.

For example, Steps S31 to S33 may be performed to set the voltage in Step S30. When the power off operation is detected, the control unit 2 first causes the capacitance element 67 in each of the plurality of pixel circuits 60 to hold an initial voltage that is higher than the threshold voltage of the drive transistor 61 and does not cause the EL element 66 to emit light (Step S31). This operation is performed in the period from the rising edge of the REF signal (reference voltage power line 68) to the falling edge of the INI signal (init line 74) in the off sequence in FIG. 4, i.e. in period T22 (initialization period) in FIG. 5 described later.

Following this, the control unit 2 turns on the enable switch 65, to bring into conduction the drive transistor 61 with the initial voltage that is higher than the threshold voltage and does not cause the EL element 66 to emit light being applied to its gate (Step S32). This operation is performed when the ENB signal (enable line 75) rises to high level in the off sequence in FIG. 4, i.e. at time t3 (at the start of the threshold setting period) in FIG. 5.

After the ENB signal rises to high level in the off sequence in FIG. 4, the voltage of the capacitance element 67 decreases due to the conduction current flowing through the drive transistor 61, as a result of which the drive transistor 61 automatically changes from a conducting state to a nonconducting state (Step S33). In this nonconducting state, the capacitance element 67 holds the voltage equivalent to the threshold voltage of the drive transistor 61. This operation is performed in period T24 (threshold setting period) in FIG. 5.

The control unit 2 then turns off the enable switch 65. The operation of turning off the enable switch 65 corresponds to the falling edge of the ENB signal (enable line 75) in the off sequence in FIG. 4.

As a result of Steps S31 to S33, even when the threshold voltage of the drive transistor 61 varies among the plurality of pixel circuits 60, in each individual pixel circuit 60 the voltage equivalent to the threshold voltage of the drive transistor 61 can be set in the capacitance element 67. In other words, the voltage equivalent to the threshold voltage of each individual drive transistor 61 whose threshold voltage has shifted can be set in the corresponding capacitance element 67. This suppresses variations in threshold voltage shift in the power off state of the display device 1.

The off sequence operation in FIG. 4 is described in more detail below.

FIGS. 6A to 6E are diagrams illustrating the operation of the pixel circuit 60 in periods T21 to T25 in FIG. 5. The operation of the pixel circuit 60 in periods T21 to T25 in the off sequence in FIG. 5 is the same as that in periods T21 to T25 in one frame in FIG. 7 illustrating an example of a timing chart of normal display. At the end of period T25, each pixel circuit 60 is in a state where the voltage equivalent to the threshold voltage of the drive transistor 61 is held in the capacitance element 67 and applied to the gate, as described below.

(Period T21)

Period T21 from time t0 to time t1 in FIG. 5 is a period for stabilizing the potential of node B (setting the potential of node B to the voltage $V_{INI}$ of the initialization power line 71) by putting only the switch 64 in a conducting state.

Figure 6A:
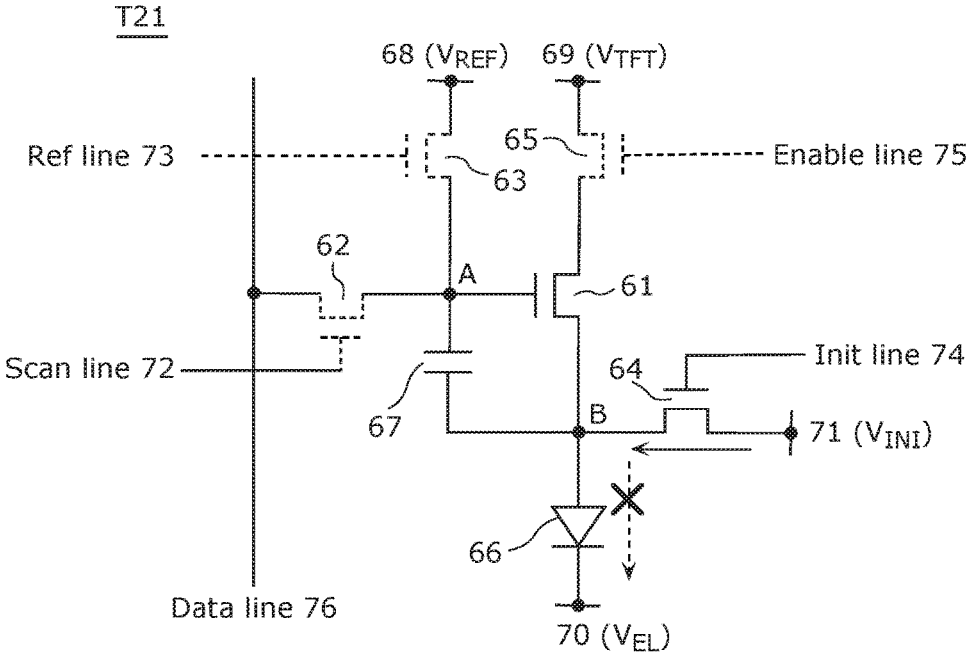
FIG. 6A is a diagram illustrating the operation of the pixel circuit in period T21 in FIGS. 5 and 7.
Figure 7:
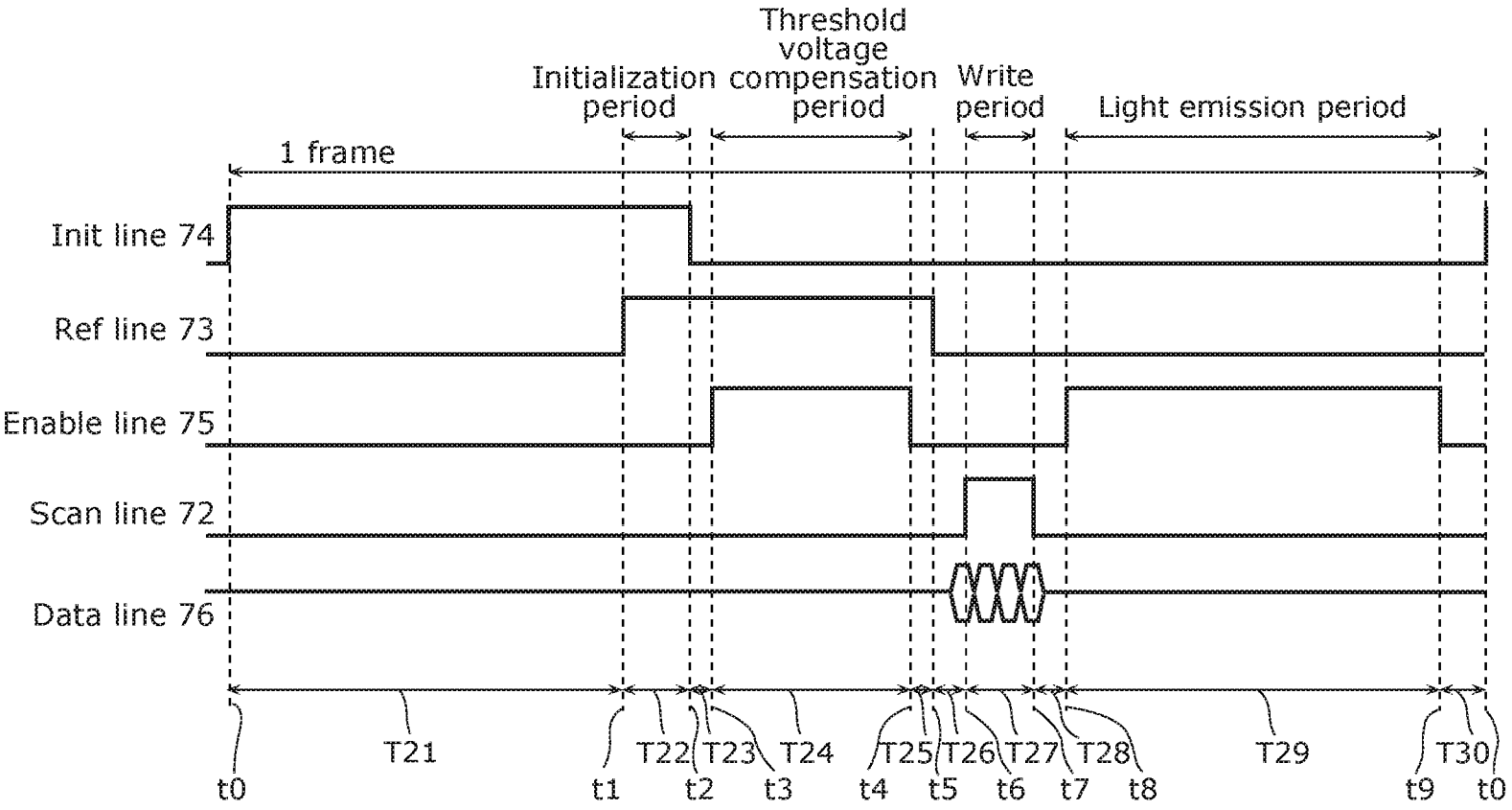
FIG. 7 is a timing chart illustrating an example of the detailed timings of the normal display operation in FIG. 4.

In detail, at time t0, the scan line drive circuit 3 changes the voltage level of the init line 74 from low to high while maintaining the voltage levels of the scan line 72, ref line 73, and enable line 75 low, as illustrated in the operation state of the pixel circuit 60 in FIG. 6A. Thus, at time t0, the switch 64 is brought into conduction (on) while the switch 62, the switch 63, and the enable switch 65 remain nonconducting (off).

Period T21 in which only the switch 64 from among the switches 62, 63, and 64 and the enable switch 65 is conducting is provided by operating the init line 74, with it being possible to set the potential of node B to the voltage $V_{INI}$ of the initialization power line 71.

Such period T21 is provided for the following reason.

In the case where the size of the display panel 6 or the size per pixel (the size of the pixel circuit 60) in the display device 1 is large, the capacitance of the EL element 66 is large, and the wiring time constant of the initialization power line 71 is large. Hence, setting the voltage of node B to the voltage $V_{INI}$ of the initialization power line 71 requires time. By providing period T21 for bringing the switch 64 into conduction beforehand, the potential of node B can be set to the voltage $V_{INI}$ of the initialization power line 71 more reliably.

Applying the voltage $V_{REF}$ of the reference voltage power line 68 to node A equally requires time. However, charging/discharging with the voltage $V_{REF}$ is directed to the capacitance element 67 and the wiring time constant of the reference voltage power line 68 and, while the wiring time constants of the reference voltage power line 68 and initialization power line 71 are approximately equal, (the capacitance of the EL element 66)>(the capacitance element 67), and the capacitance ratio of (the EL element 66)/(the capacitance element 67) is 1.3 to 9. Accordingly, charging the EL element 66 (writing the voltage $V_{INI}$ of the initialization power line 71 to the potential of node b) takes more time than charging the capacitance element 67 (writing the voltage $V_{REF}$ of the reference voltage power line 68 to the potential of node A).

Moreover, bringing only the switch 64 into conduction in period T21 while delaying the conduction of the switch 63 has the following advantage.

The advantage of providing the period for writing the voltage $V_{INI}$ of the initialization power line 71 to the potential of node b in period T21 is that the load of writing the voltage $V_{REF}$ of the reference voltage power line 68 to node A is reduced. By providing period T21, the voltage of node A can be set to a lower voltage, so that the reference voltage power line 68 only needs to supply a current (voltage) for charging the pixel circuit 60. In other words, the voltage $V_{REF}$ of the reference voltage power line 68 is not used as a voltage for charging the EL element 66, which provides the advantage that the load of the reference voltage power line 68 is reduced.

Period T21 for switching only the switch 64 to a conducting state (on) to determine the potential of node B first is thus provided. This shortens the total time of period T22 which follows period T21, while reducing the power consumption of the display panel 6 and the effect of the luminance variations of the display panel 6.

(Period T22: Initialization Period)

Period T22 from time t1 to time t2 in FIG. 5 is an initialization period for holding, in the capacitance element 67, the initial voltage necessary to pass the drain current in order to perform threshold voltage compensation for the drive transistor 61, and applying the initial voltage between the source and gate of the drive transistor 61.

Figure 6B:
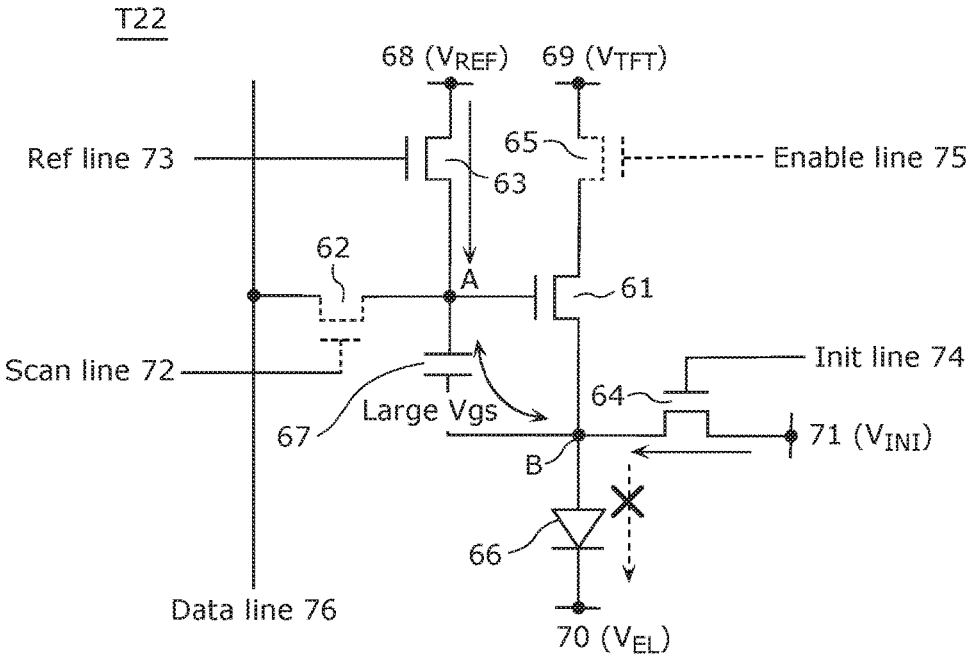
FIG. 6B is a diagram illustrating the operation of the pixel circuit in period T22 in FIGS. 5 and 7.

In detail, at time t1, the scan line drive circuit 3 changes the voltage level of the ref line 73 from low to high while maintaining the voltage levels of the scan line 72 and enable line 75 low and the voltage level of the init line 74 high, as illustrated in the operation state of the pixel circuit 60 in FIG. 6B. Thus, at time t1, the switch 63 is brought into conduction (on) while the switch 62 and the enable switch 65 remain nonconducting (off) and the switch 64 remains conducting (on).

The potential of node A is set to the voltage $V_{REF}$ of the reference voltage power line 68 in this way. Since the switch 64 is conducting, the potential of node B is set to the voltage $V_{INI}$ of the initialization power line 71. Accordingly, the voltage $V_{REF}$ of the reference voltage power line 68 and the voltage $V_{INI}$ of the initialization power line 71 are applied to the drive transistor 61.

Period T22 has such a length (duration) that allows the potential of each of nodes A and B to reach a predetermined potential.

The gate-source voltage of the drive transistor 61 needs to be set to such an initial voltage that ensures the initial drain current necessary for the threshold compensation operation, as mentioned earlier. Hence, the initial voltage needs to be such a voltage that is higher than the threshold voltage of the drive transistor 61 and does not cause the EL element 66 to emit light, in the capacitance element 67 in each of the plurality of pixel circuits 60. The potential difference between the voltage $V_{REF}$ of the reference voltage power line 68 and the voltage $V_{INI}$ of the initialization power line 71 is accordingly set to a higher voltage than the maximum threshold voltage of the drive transistor 61. Moreover, to keep current from flowing to the EL element 66, the voltage $V_{REF}$ and the voltage $V_{INI}$ are set so that (voltage $V_{INI}$)< (voltage $V_{EL}$)+(the forward current threshold voltage of the EL element 66) and $V_{REF}$<(voltage $V_{EL}$)+(the forward current threshold voltage of the EL element 66)+(the threshold voltage of the drive transistor 61).

(Period T23)

Period T23 from time t2 to time t3 in FIG. 5 is a period for preventing the switch 64 and the enable switch 65 from being in a conducting state simultaneously.

Figure 6C:
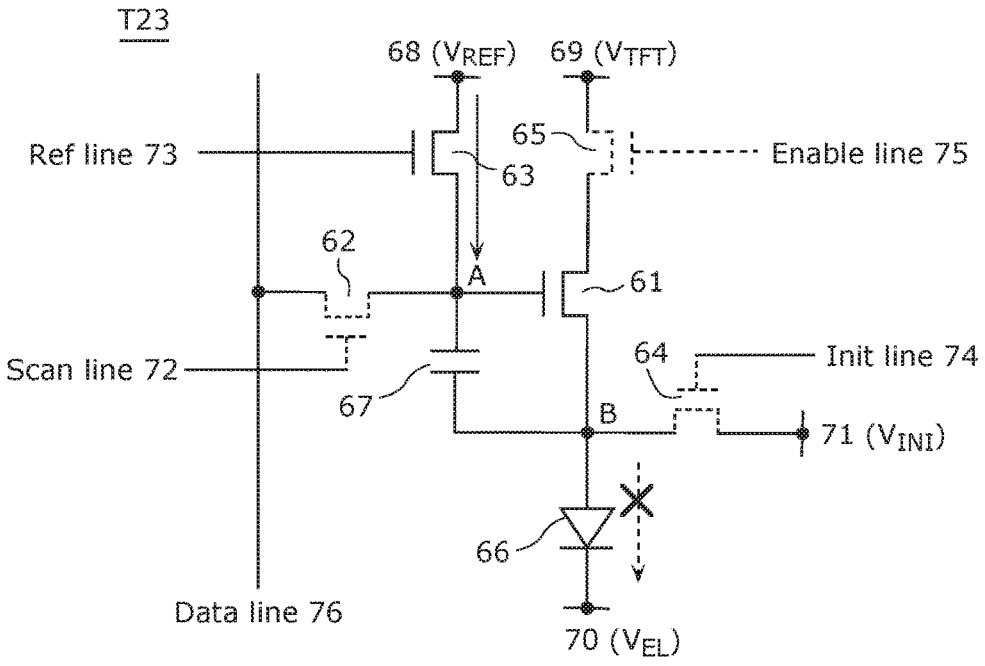
FIG. 6C is a diagram illustrating the operation of the pixel circuit in period T23 in FIGS. 5 and 7.

In detail, at time t2, the scan line drive circuit 3 changes the voltage level of the init line 74 from high to low while maintaining the voltage levels of the scan line 72 and enable line 75 low and the voltage level of the ref line 73 high, as illustrated in the operation state of the pixel circuit 60 in FIG. 6C. Thus, at time t2, the switch 64 is brought out of conduction (off) while the switch 62 and the enable switch 65 remain nonconducting (off) and the switch 63 remains conducting (on).

Period T23 in which the switch 64 is nonconducting is provided by operating the init line 74, with it being possible to prevent a situation where, without period T23, the switch 64 and the enable switch 65 are conducting simultaneously and a through current flows between the EL anode power line 69 and the initialization power line 71 via the enable switch 65, the drive transistor 61, and the switch 64.

(Period T24: Threshold Setting Period/Threshold Compensation Period)

Period T24 from time t3 to time t4 in FIG. 5 is a threshold setting period for compensating variations in the threshold voltage of the drive transistor 61 among the plurality of pixel circuits 60. In other words, period T24 is a period for setting, even though the threshold voltage of the drive transistor 61 varies among the plurality of pixel circuits 60, the voltage equivalent to the threshold voltage of each individual drive transistor 61 in the corresponding capacitance element 67.

The off sequence in FIG. 5 and the normal display in FIG. 7 have the same periods T21 to T25. Since the off sequence and the normal display have different purposes, however, period T25 in FIG. 5 is referred to as a threshold setting period, and period T25 in FIG. 7 as a threshold compensation period. The difference lies in that, while the threshold setting period in FIG. 5 is intended to define the voltage of the capacitance element 67 after power off of the display device 1, the threshold compensation period in the normal display in FIG. 7 is intended to deal with threshold voltage variations by a voltage that is written to the capacitance element 67 after period T25 and represents luminance.

Figure 6D:
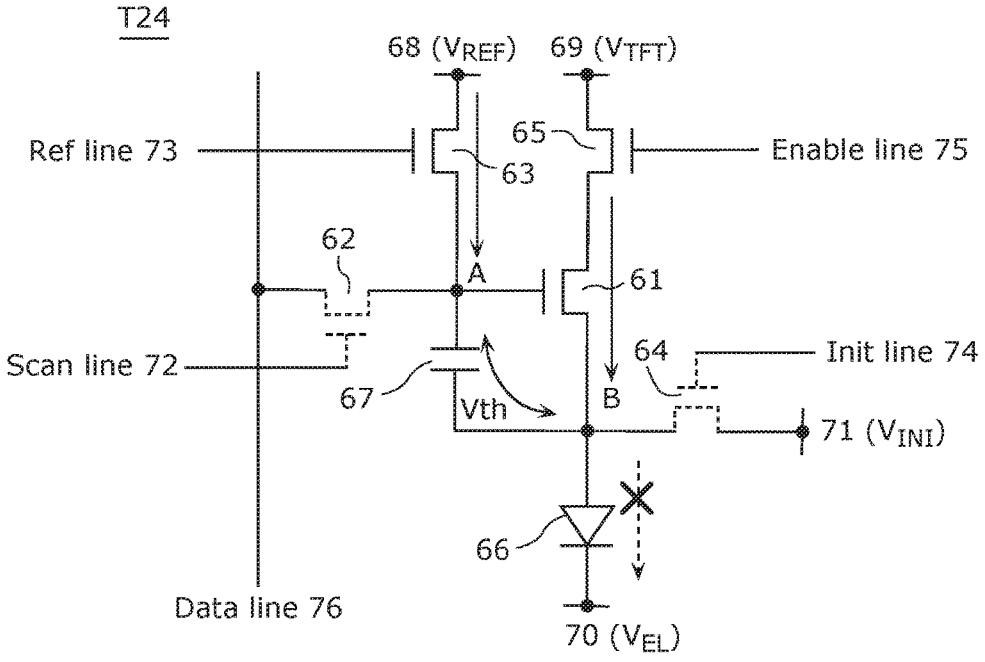
FIG. 6D is a diagram illustrating the operation of the pixel circuit in period T24 in FIGS. 5 and 7.

At time t3 in period T24, the scan line drive circuit 3 changes the voltage level of the enable line 75 from low to high while maintaining the voltage levels of the scan line 72 and init line 74 low and the voltage level of the ref line 73 high, as illustrated in the operation state of the pixel circuit 60 in FIG. 6D. Thus, at time t3, the enable switch 65 is brought into conduction (on) while the switches 62 and 64 remain nonconducting (off) and the switch 63 remains conducting (on).

Since the voltage of the capacitance element 67 has been set to the initial voltage from the initialization period (period T22) as mentioned above, no current flows through the EL element 66. The drive transistor 61 is supplied with the drain current by the voltage $V_{TFT}$ of the EL anode power line 69, along with which the source potential of the drive transistor 61 changes. The source potential of the drive transistor 61 changes until the drain current supplied by the voltage $V_{TFT}$ of the EL anode power line 69 reaches 0.

Thus, the threshold compensation operation of the drive transistor 61 can be started by bringing the enable switch 65 into conduction (on) in a state where the voltage $V_{REF}$ of the reference voltage power line 68 is input to the gate electrode of the drive transistor 61.

At the end (time t4) of period T24, the potential difference between nodes A and B (the gate-source voltage of the drive transistor 61) has become the potential difference equivalent to the threshold of the drive transistor 61. This voltage is held in the capacitance element 67.

(Period T25)

Period T25 from time t4 to time t5 in FIG. 5 is a period for completing the threshold setting operation or the threshold compensation operation.

Figure 6E:
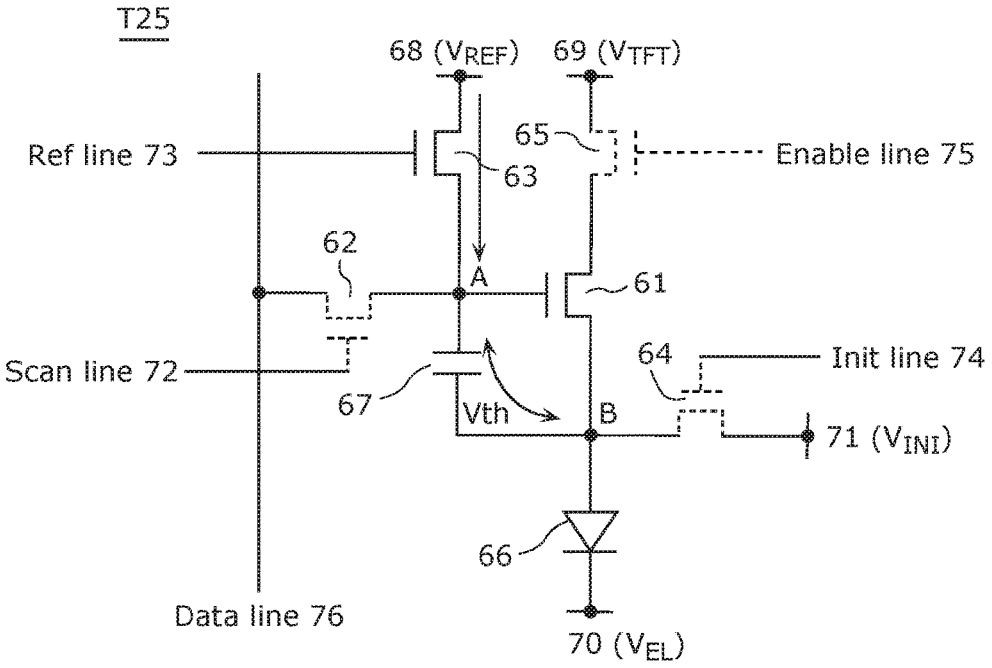
FIG. 6E is a diagram illustrating the operation of the pixel circuit in period T25 in FIGS. 5 and 7.

In detail, the scan line drive circuit 3 changes the voltage level of the enable line 75 from high to low while maintaining the voltage levels of the scan line 72 and init line 74 low and the voltage level of the ref line 73 high, as illustrated in the operation state of the pixel circuit 60 in FIG. 6E. Thus, at time t4, the enable switch 65 is brought out of conduction (off) while the switches 62 and 64 remain nonconducting (off) and the switch 63 remains conducting (on).

Period T25 in which the enable switch 65 is nonconducting is provided by operating the enable line 75, with it being possible to stop current supply from the EL anode power line 69 to node B via the drive transistor 61 and ensure the completion of the threshold setting operation or threshold compensation operation before launching the next operation.

The capacitance element 67 in each of the plurality of pixel circuits 60 accordingly holds the voltage equivalent to the threshold voltage of the corresponding drive transistor 61, at time t5 at the end of period T25.

The operation in periods T21 to T25 described above is performed on all rows of the display panel 6 one at a time. As a result of the completion of the operation in periods T21 to T25 for the last row, the capacitance element 67 in each pixel circuit 60 of every row in the display panel 6 holds the voltage equivalent to the threshold voltage of the corresponding drive transistor 61.

(Period T90)

Once the operation in periods T21 to T25 for the last row has been completed, at any point in period T90 following time t5 in FIG. 5, the power unit 4 stops power supply to the display panel 6, the scan line drive circuit 3, the data line drive circuit 5, and the like, under control by the control unit 2. This puts the display device 1 in a power off state.

As a result, in the power off state of the display device 1, the capacitance element 67 holds the voltage equivalent to the threshold of the drive transistor 61, that is, the voltage equivalent to the threshold is being applied to the gate of the drive transistor 61. In such a state, the electric field of the drive transistor is balanced stably, so that electrical stress is substantially suppressed.

Even when the threshold voltage of the drive transistor 61 varies among the plurality of pixel circuits 60, in each individual pixel circuit 60 the capacitance element 67 holds the voltage equivalent to the threshold voltage of the corresponding drive transistor 61. In other words, the voltage equivalent to the threshold voltage of each individual drive transistor 61 whose threshold voltage has shifted is held in the corresponding capacitance element 67. This produces the advantageous effect of suppressing the threshold voltage shift in the power off state of the display device 1 and, even when the threshold voltage varies among the drive transistors 61, suppressing such variations in threshold voltage.

The following describes the frame-by-frame display operation in the normal display illustrated in FIG. 4.

FIG. 7 is a timing chart illustrating an example of the detailed timings of the normal display operation in FIG. 4. FIGS. 6A to 6H are diagrams illustrating the operation of the pixel circuit 60 in periods T21 to T30 in FIG. 7.

Periods T21 to T25 in FIG. 7 are the same as periods T21 to T25 in FIG. 5, which have already been described above. The operation from period T26 is described below.

(Period T26)

Period T26 from time t5 to time t6 in FIG. 7 is a period for preventing the simultaneous application of the data signal voltage supplied via the data line 76 and the voltage $V_{REF}$ of the reference voltage power line 68 to node A by bringing the switch 63 out of conduction (off).

Figure 6F:
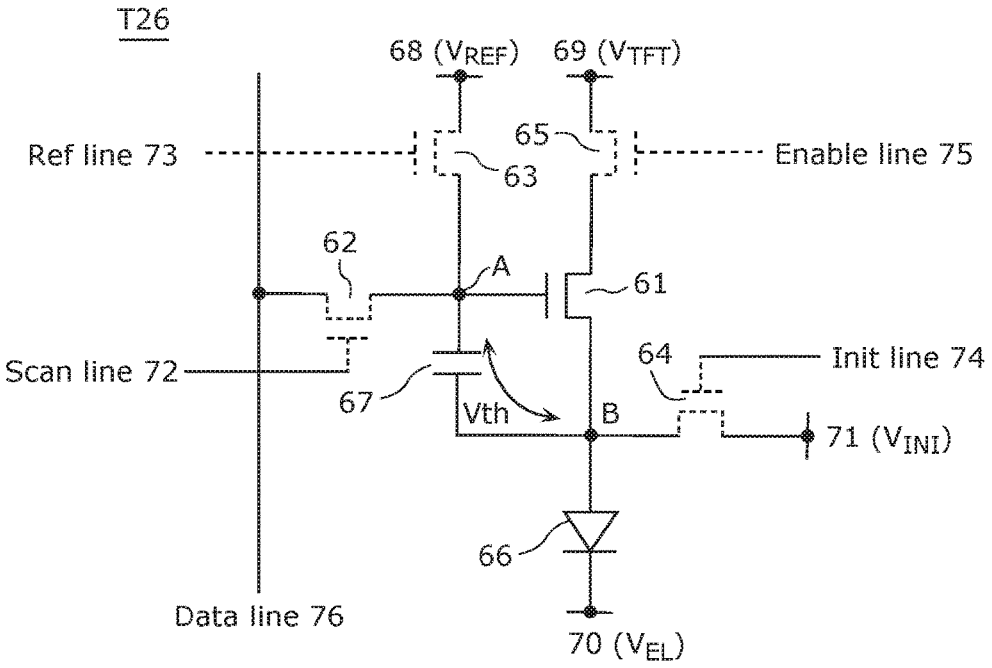
FIG. 6F is a diagram illustrating the operation of the pixel circuit in period T26 in FIG. 7.

In detail, at time t5, the scan line drive circuit 3 changes the voltage level of the ref line 73 from high to low while maintaining the voltage levels of the scan line 72, init line 74, and enable line 75 low, as illustrated in the operation state of the pixel circuit 60 in FIG. 6F. Thus, at time t5, the switch 63 is brought out of conduction (off) while the switches 62 and 64 and the enable switch 65 remain nonconducting (off).

Period T26 in which the switches 62 and 63 are nonconducting (off) is provided by operating the ref line 73 to further bring the switch 63 out of conduction, with it being possible to prevent the simultaneous application of the data signal voltage (video signal voltage) supplied from the data line 76 via the switch 62 and the voltage $V_{REF}$ of the reference voltage power line 68 to node A.

The enable switch 65 connected to the enable line 75 is connected to the drain of the drive transistor 61, as illustrated in FIG. 6F (FIG. 2). In the case where the enable switch 65 is an n-type transistor, the on resistance of the enable switch 65 tends to be high, and the voltage drop by the on resistance affects the power consumption of the display panel 6. Accordingly, the enable switch 65 is formed to have as low an on resistance as possible. Known typical methods of decreasing the on resistance include increasing the channel size of the enable switch 65 and increasing the on control voltage of the enable line 65. These methods all cause the fall time of the enable line 75 to be longer.

In view of this, in this embodiment, period T25 in which the enable line 75 falls prior to the ref line 73 is provided to shorten the period during which the voltage of node A is unstable, i.e. shorten the fall time.

(Period T27: Write Period)

Period T27 from time t6 to time t7 in FIG. 7 is a write period for acquiring in the pixel circuit 60 a video signal voltage (data signal voltage) corresponding to a display gray level from the data line 76 via the switch 62 and writing the video signal voltage to the capacitance element 67.

Figure 6G:
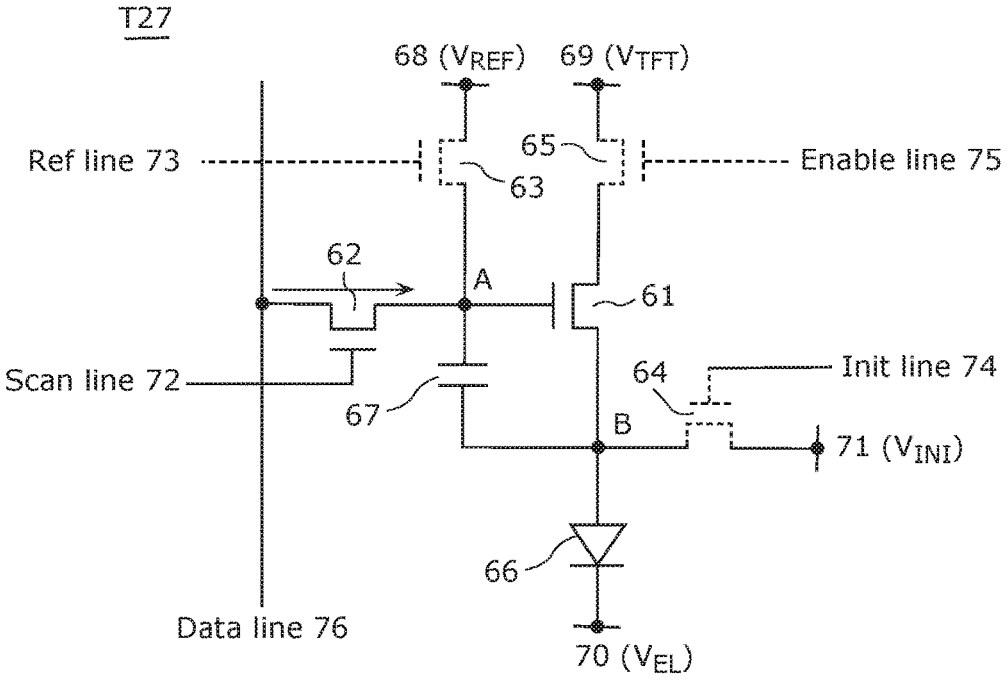
FIG. 6G is a diagram illustrating the operation of the pixel circuit in period T27 in FIG. 7.

In detail, at time t6, the scan line drive circuit 3 changes the voltage level of the scan line 72 from low to high while maintaining the voltage levels of the init line 74, ref line 73, and enable line 75 low, as illustrated in the operation state of the pixel circuit 60 in FIG. 6G. Thus, at time t6, the switch 62 is brought into conduction (on) while the switches 63 and 64 and the enable switch 65 remain nonconducting (off).

As a result, in addition to the threshold voltage Vth of the drive transistor 61 stored in the threshold compensation period, the voltage difference between the video signal voltage and the voltage $V_{REF}$ of the reference voltage power line 68, which is multiplied by (the capacitance of the EL element 66)/(the capacitance of the EL element 66+the capacitance of the capacitance element 67), is stored (held) in the capacitance element 67. Since the enable switch 65 is nonconducting, no drain current passes through the drive transistor 61. Therefore, the potential of node B does not change significantly during period T27.

With an increase in screen size (increase in the size of the display panel 6) and an increase in the number of pixel circuits 60, the period (horizontal scanning period) for writing a video signal to the pixel circuit 60 shortens. An increase in screen size also involves an increase in the wiring time constant of the scan line 72. This, together with the shorter horizontal scanning period, makes it difficult to write a predetermined gray level voltage to the pixel circuit 60.

In view of this, the time (period T27) during which the switch 62 is conducting is increased to acquire the video signal (data signal voltage) within a limited time in this embodiment, as illustrated in FIG. 7. Moreover, in this embodiment, even when the scan line 72 has a rounded waveform, the rise of the scan line 72 is completed so that the switch 62 is conducting (on) before the predetermined video signal (data signal voltage) is input to the data line 76. This is intended to prevent a significant change of the potential of node B during period T27.

In this way, the voltage corresponding to the data signal voltage (video signal voltage) and the threshold voltage of the drive transistor 61 is stored (held) in the capacitance element 67 in period T27 (write period).

(Period T28)

Period T28 from time t7 to time t8 in FIG. 7 is a period for ensuring that the switch 62 is brought out of conduction.

Figure 6H:
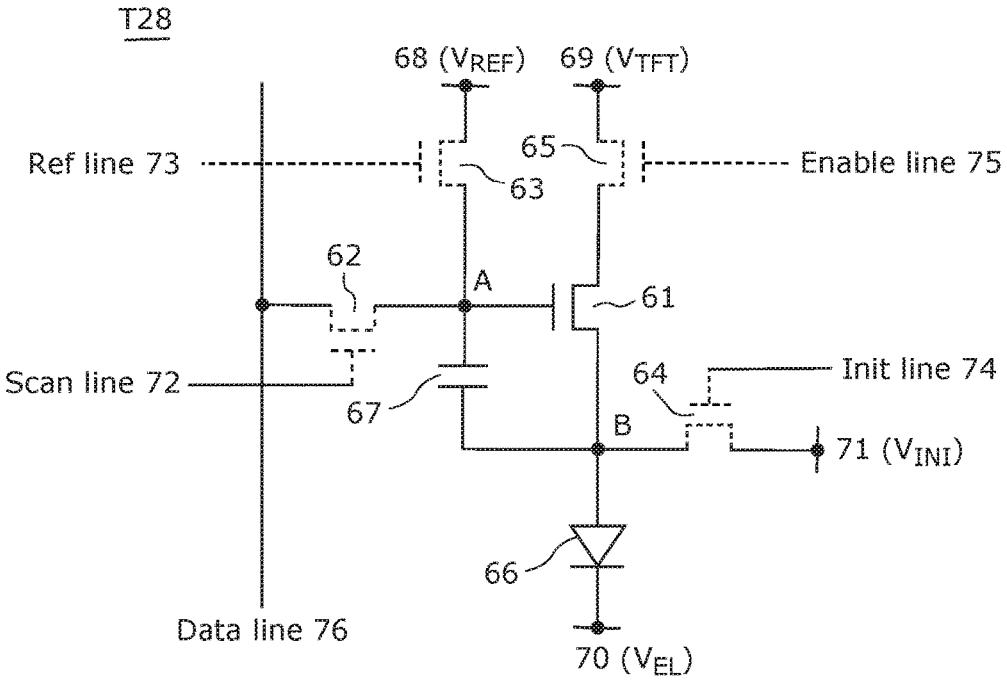
FIG. 6H is a diagram illustrating the operation of the pixel circuit in period T28 in FIG. 7.

In detail, at time t7, the scan line drive circuit 3 changes the voltage level of the scan line 72 from high to low while maintaining the voltage levels of the ref line 73, init line 74, and enable line 75 low, as illustrated in the operation state of the pixel circuit 60 in FIG. 6H. Thus, at time t7, the switch 62 is brought out of conduction (off) while the switches 63 and 64 and the enable switch 65 remain nonconducting (off).

This ensures that the switch 62 is nonconducting (off) before the enable switch 65 is brought into conduction (on) in the succeeding period T29 (light emission period).

In the case where period T28 is not provided and the enable switch 65 and the switch 62 are conducting (on) simultaneously, the potential of node B increases due to the drain current of the drive transistor 61 while the potential of node A is set to the data signal voltage, as a result of which the source-gate voltage of the drive transistor 61 decreases. This causes a problem in that light is emitted with luminance lower than desired luminance. To avoid such a problem, in this embodiment, period T28 is provided to ensure that the switch 62 is nonconducting before the enable switch 65 is brought into conduction in the succeeding period T29.

(Period T29: Light Emission Period)

Period T29 from time t8 to time t9 in FIG. 7 is a light emission period.

In detail, at time t8, the scan line drive circuit 3 changes the voltage level of the enable line 75 from low to high while maintaining the voltage levels of the scan line 72, ref line 73, and init line 74 low. Thus, at time t8, the enable switch 65 is brought into conduction (on) while the switches 62, 63, and 64 remain nonconducting (off).

By bringing the enable switch 65 into conduction (on) in this way, the drive transistor 61 supplies current to the EL element 66 according to the voltage stored in the capacitance element 67, and as a result the EL element 66 emits light.

(Period T30)

Period T30 from time t9 to time t10 in FIG. 7 is a period for putting all switches in a nonconducting state so that the potential of each of nodes A and B changes to a voltage close to the voltage necessary in period T21.

In detail, at time t9, the scan line drive circuit 3 changes the voltage level of the enable line 75 from high to low while maintaining the voltage levels of the scan line 72, ref line 73, and init line 74 low. Thus, at time t9, the enable switch 65 is brought out of conduction (off) while the switches 62, 63, and 64 remain nonconducting (off).

By providing period T30 between period T29 and period T21, the potential of each of nodes A and B can be changed to a voltage close to the voltage necessary in the succeeding period T21 without charging/discharging by a power line.

The pixel circuit 60 performs normal display according to the sequence described above. The operation in periods T21 to T25 (to the threshold voltage compensation operation) in the normal display in FIG. 7 is the same as the operation in periods T21 to T25 (to the threshold voltage setting operation) in the off sequence in FIG. 5, where the voltage equivalent to the threshold voltage of the drive transistor 61 is set in the capacitance element 67.

Thus, in the normal display in FIG. 7, the EL element 66 can emit the amount of light corresponding to the data signal voltage (video signal voltage) even when the threshold voltage of the initialization power line 71 varies among the pixel circuits 60. In the off sequence in FIG. 5, electrical stress on the drive transistor 61 after power off can be suppressed.

The operation in periods T21 to T25 in FIG. 7 is basically a line sequential operation in which the display lines of the display panel are processed sequentially. The operation in periods T21 to T25 in FIG. 5, on the other hand, may be a line sequential operation or a batch setting operation in which all display lines of the display panel are processed simultaneously. In the batch setting, the voltage equivalent to the threshold voltage of the drive transistor 61 is simultaneously set in the capacitance element 67 in each of the plurality of pixel circuits 60 of all display lines.

The off sequence period in FIG. 5 may be the same as or different from the one-frame period in FIG. 7. For example, the batch setting operation of the off sequence in FIG. 5 increases the effect of delay by wiring stray capacitance as compared with the line sequential operation, but can shorten the off sequence period relative to the total time of line sequential operation on all pixel lines.

[1-3. Advantageous Effects]

As described above, one aspect of a power off method of a display device according to the disclosure is a power off method of a display device that includes a display panel having a plurality of pixel circuits arranged in a matrix, each of the plurality of pixel circuits including: a light emitting element that emits light with luminance corresponding to an amount of current supplied; a drive transistor that supplies the current to the light emitting element; and a capacitance element that is connected to a gate of the drive transistor and holds a voltage representing the luminance, the power off method of a display device including: detecting a power off operation on the display device; setting, when the power off operation is detected, a voltage for suppressing electrical stress on the drive transistor, in the capacitance element in each of the plurality of pixel circuits; and stopping power supply to the display panel immediately after the voltage is set, wherein in the setting, a voltage equivalent to a threshold voltage of the drive transistor is set in the capacitance element in each of the plurality of pixel circuits.

With this method, the threshold voltage shift of the drive transistor in the period during which the power of the display device is off can be prevented. In detail, the threshold voltage shift can be prevented by suppressing electrical stress on the drive transistor during power off.

Moreover, in the setting: an initial voltage that is higher than the threshold voltage of the drive transistor and does not cause the light emitting element to emit light may be held in the capacitance element in each of the plurality of pixel circuits; the drive transistor may be brought into conduction by the initial voltage; the voltage of the capacitance element may be decreased by a conduction current flowing through the drive transistor brought into conduction; and the drive transistor may be brought out of conduction by the decrease of the voltage of the capacitance element, and the voltage equivalent to the threshold voltage may be a voltage when the drive transistor is brought out of conduction.

With this method, the voltage equivalent to the threshold voltage of each individual drive transistor can be set in the corresponding capacitance element, instead of uniformly setting the same voltage in the capacitance element in each of the plurality of pixel circuits. The voltage equivalent to the threshold voltage of each individual drive transistor can be set in this way.

Moreover, in the setting, the voltage equivalent to the threshold voltage of the drive transistor may be set in the capacitance element in each of the plurality of pixel circuits simultaneously.

With this method, the capacitance elements in all pixel circuits are set in a batch, thus reducing the time to stop power supply.

One aspect of a display device according to the disclosure is a display device including a display panel having a plurality of pixel circuits arranged in a matrix, each of the plurality of pixel circuits including: a light emitting element that emits light according to an amount of current supplied; a drive transistor that supplies the current to the light emitting element; and a capacitance element that is connected to a gate of the drive transistor and holds a voltage representing luminance, the display device including: a control unit that sets, when a power off operation is detected, a voltage for suppressing electrical stress on the drive transistor, in the capacitance element in each of the plurality of pixel circuits; and a power unit that stops power supply to the display panel immediately after the control unit sets the voltage, wherein the control unit sets a voltage equivalent to a threshold voltage of the drive transistor, as the voltage for suppressing electrical stress on the drive transistor.

With this structure, the threshold voltage shift of the drive transistor in the period during which the power of the display device is off can be prevented.

[Modifications]

Although the embodiment has been described above to illustrate the disclosed technique, the disclosed technique is not limited to such. Changes, replacements, additions, omissions, etc. may be made to the embodiment as appropriate, and structural elements described in the embodiment may be combined to form a new embodiment.

Figure 8:
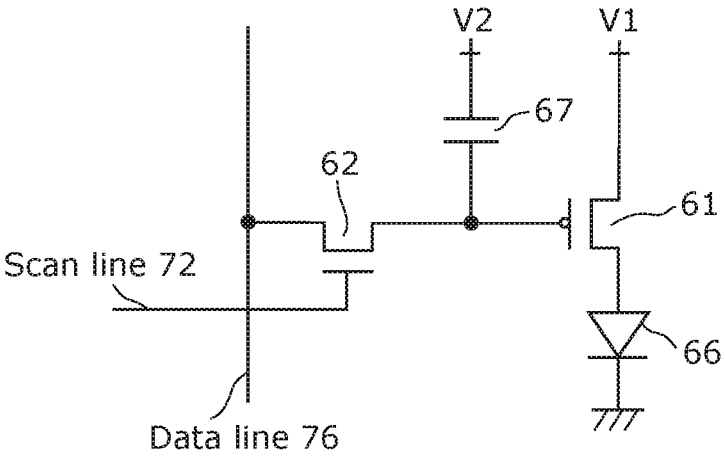
FIG. 8 is a circuit diagram illustrating an example of a display pixel according to a modification of the embodiment.

FIG. 8 is a circuit diagram illustrating an example of a display pixel according to a modification of the embodiment. The pixel circuit in FIG. 8 includes the drive transistor 61, the switch 62, the EL element 66, and the capacitance element 67, and has a simpler structure than the pixel circuit in FIG. 2.

The drive transistor 61 in FIG. 8 is not an n-type TFT but a p-type TFT, and has its drain connected to a power line of a voltage V1.

The capacitance element 67 has one electrode connected to a power line of a voltage V2. The voltage V1 may be the same as the voltage V2.

The switch 62 has one of its source and drain connected to the data line 76, the other one of its source and drain connected to the other electrode of the capacitance element 67, and its gate connected to the scan line 72.

With this structure, in the off sequence, first the potential of the data line 76 is set to (voltage V1)−(the threshold voltage of the drive transistor 61), and then the scan line 72 is driven high (i.e. the switch 62 is turned on). As a result, the voltage equivalent to the threshold voltage of the drive transistor 61 is held in the capacitance element 67. The held voltage is applied to the gate of the drive transistor 61. This suppresses electrical stress on the drive transistor 61. In this state, the power unit 4 stops power supply to the display panel 6.

Thus, the pixel circuit 60 is not limited to the circuit example in FIG. 2, and may be the circuit example in FIG. 8. In the circuit example in FIG. 8, a switch may be added between the power line of the voltage V1 and the drive transistor 61, with the enable line 75 being connected to the gate of the switch. In the circuit example in FIG. 8, a switch may be added between the power line of the voltage V2 and the drive transistor 61, with the ref line 73 being connected to the gate of the switch. In the circuit example in FIG. 8, the initialization power line 71 may be connected to the anode of the EL element 66 via a switch, with the init line 74 being connected to the gate of the switch.

The drive transistor 61 may be n-type or p-type as illustrated in FIG. 2 or 8.

Another Embodiment

Another embodiment of the disclosure is described below, with reference to FIGS. 9 and 10. The structures of the display device and pixel circuit in this embodiment are the same as those in FIGS. 1 and 2. The power off method and the timing chart in this embodiment are also the same as those in FIGS. 3 and 4. The display device 1 in this embodiment supports 4K television, and has effective pixels of at least 3840 horizontal pixels×2160 vertical pixels. This embodiment has drive timings different from the drive timings of the normal display operation in FIG. 7 and off sequence in FIG. 5 in the foregoing embodiment. The following describes an example of operation suitable for such a display device.

An example of the drive timings of the normal display in this embodiment is described first.

Figure 9:
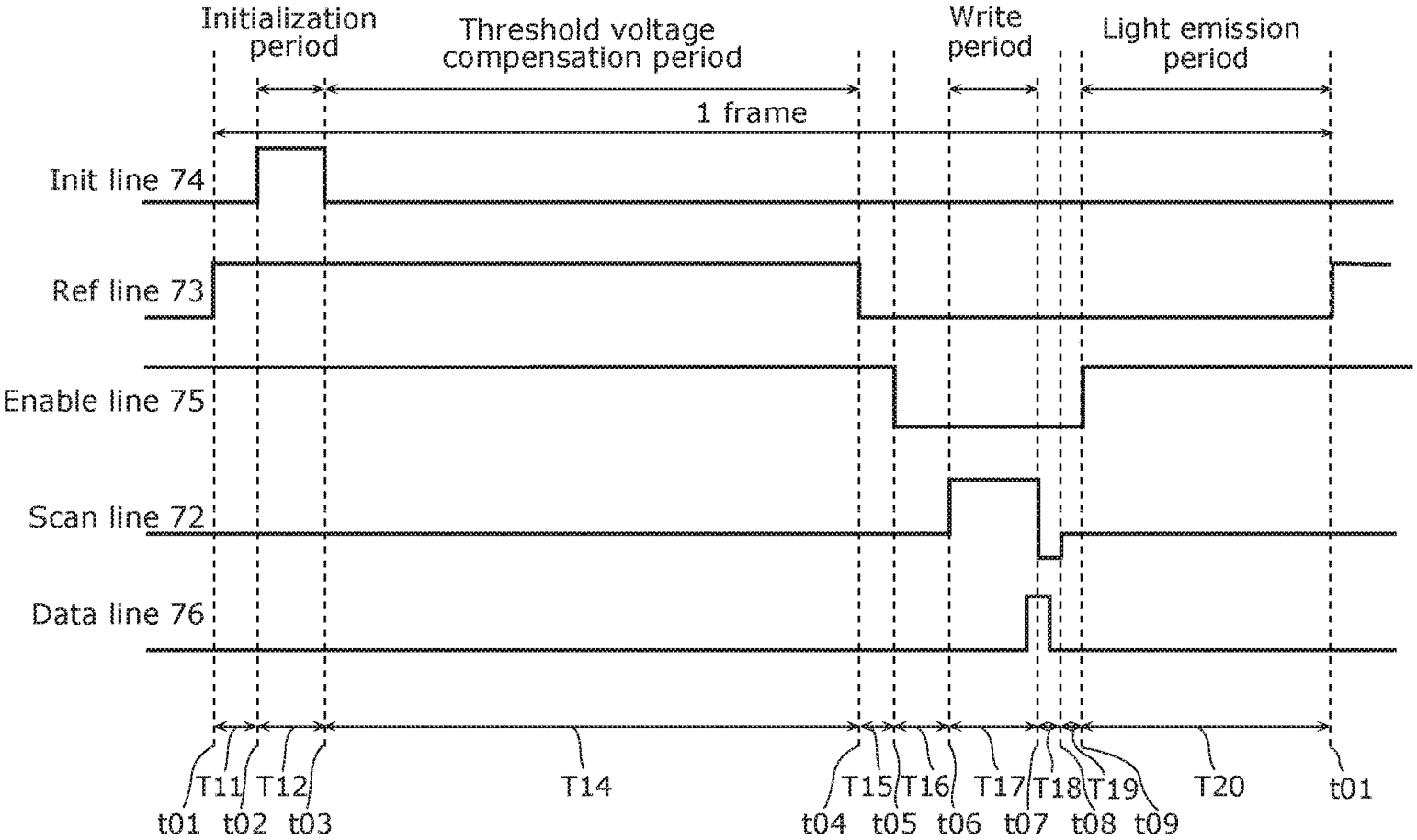
FIG. 9 is a timing chart illustrating an example of the detailed timings of the normal display operation according to another embodiment.

FIG. 9 is a timing chart illustrating an example of the detailed timings of the normal display operation according to this embodiment. It is assumed in FIG. 9 that one frame period (i.e. the period 1V of the vertical synchronization signal) corresponds to 2250 horizontal periods (i.e. 2250 times the period of the horizontal synchronization signal). FIG. 9 is the same as FIG. 7 in that the initialization period, the threshold voltage compensation period, the write period, and the light emission period appear in this order, but differs from FIG. 7 in part of the drive timings. The differences are mainly described below.

At time t01, the ref line 73 transitions from low to high. This rise causes the EL element 66 not to emit light.

The non-light emission period of the EL element 66 can be adjusted by adjusting the width of period T11.

At time t02, the init line 74 transitions from low to high. This rise starts the initialization period.

Period T12 is the initialization period. A period for sufficient discharge of the parasitic capacitance of node B (the capacitance of the EL element 66) to the init line 74 is provided in the initialization period. The initialization period is also a period for discharging the parasitic capacitance of node A to determine the potential. This period is defined by a trade-off between the charge to the parasitic capacitance and the current flowing through the drive transistor 61. At the end of period T12, the initial voltage necessary for the flow of drain current in order to perform threshold voltage compensation on the drive transistor 61 is held in the capacitance element 67.

At time t03, the init line 74 transitions from high to low. This starts the threshold voltage compensation period.

Period T14 is the threshold voltage compensation period as with period T24 in FIG. 7.

At time t04, the switch 63 changes from on to off at the falling edge of the ref line 73, and thus the threshold voltage compensation period ends. The potential difference between nodes A and B (the gate-source voltage of the drive transistor 61) at this point is the potential difference equivalent to the threshold of the drive transistor 61, and this voltage is held in the capacitance element 67.

Period T15 is a period for determining the gate potential in the row, given that the gate potential of the drive transistor 61 varies when the switch 63 changes from on to off at time t04. This period is called a REF transition period.

At time t05, the enable line 75 transitions from high to low, to turn off the enable switch 65. This stops power supply to the drive transistor 61.

Period T16 is a period for establishing the same potential of the EL anode power line 69 ($V_{TFT}$) in all pixels in the row after the enable switch 65 is turned off.

Period T17 is a write period, and differs from the one in FIG. 7 in that the pulse fall of the scan line 72 is overdriven. In detail, at time t07, the pulse falls to a potential lower than the normal low level. This is intended to shorten the fall time and promptly determine the write to the capacitance element 67, as the pulse of the scan line 72 actually has a considerably rounded waveform.

Period T18 is an overdrive period.

Period T19 is a period for determining the gate potential in the row, given that the gate potential of the drive transistor 61 varies when the switch 62 changes from on to off at time t07. This period is called a SCN transition period.

At time t09, the enable line 75 transitions from low to high. This starts the light emission period.

Period T20 is the light emission period. This period is, for example, about 95% of one frame period (2250 H). In other words, light can be emitted for a period which is about 95% of one frame period.

The example of the drive timings of the normal display illustrated in FIG. 9 is suitable for a display device with a large number of pixels such as 4K television, where light emission is possible for most (about 95%) of one frame period.

An example of the drive timings of the off sequence in this embodiment is described next.

Figure 10:
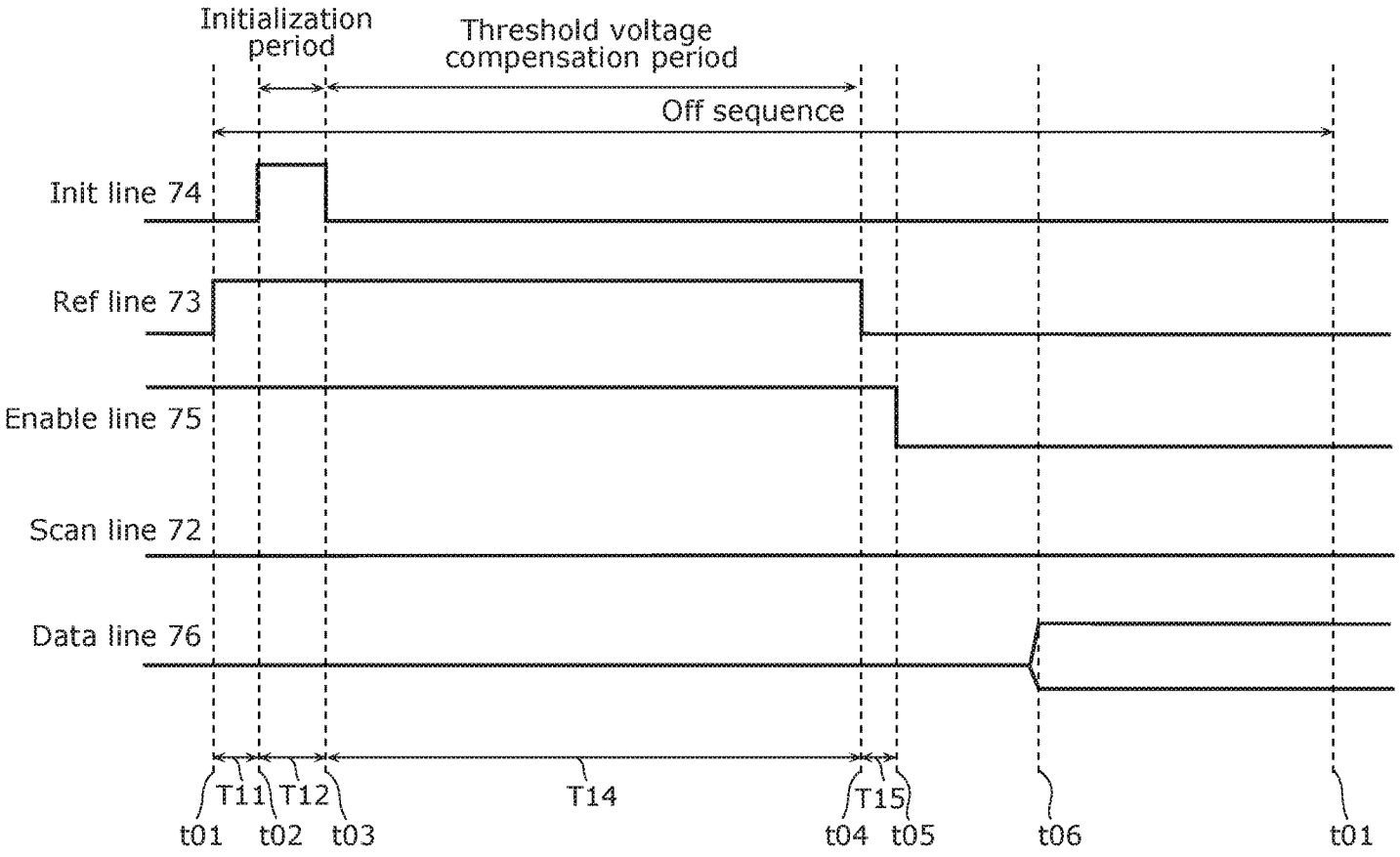
FIG. 10 is a timing chart illustrating an example of the detailed timings of the off sequence according to another embodiment.

FIG. 10 is a timing chart illustrating an example of the detailed timings of the off sequence according to this embodiment. FIG. 10 is the same as FIG. 5 in that the initialization period and the threshold voltage setting period appear in this order, but differs from FIG. 5 in part of the drive timings.

Periods T11 to T15 in FIG. 10 are the same as periods T11 to T15 in FIG. 9, which have already been described above. The operation after period T15 is described below.

Immediately after the end of period T15, the write pulse is output to the scan line 72 in FIG. 9. In FIG. 10, on the other hand, low level is maintained.

At time t05 at the end of period T15, the capacitance element 67 in each of the plurality of pixel circuits 60 holds the voltage equivalent to the threshold voltage of the corresponding drive transistor 61. This voltage held in the capacitance element 67, which is equivalent to the threshold voltage, is maintained even after the off sequence ends and the display device 1 is powered off. Hence, in the power off state of the display device 1, the voltage equivalent to the threshold is being applied to the gate of the drive transistor 61. In this state, the electric field of the drive transistor is balanced stably, so that electrical stress is substantially suppressed.

Meanwhile, no write pulse is output at time t06 after time t05, and so the data line 76 may be "don't care" (i.e. any voltage) in the off sequence period. In the off sequence, the data line drive circuit 5 may operate in the same way as in the normal operation. In such a case, data displayed if the operation is not the off sequence is output at time t06. In the off sequence, this data is ignored without being reflected in the display.

The same advantageous effects as in FIG. 5 can thus be achieved by the off sequence in FIG. 10.

Although the embodiment has been described above to illustrate the disclosed technique, the disclosed technique is not limited to such. Changes, replacements, additions, omissions, etc. may be made to the embodiment as appropriate.

For example, the material of the semiconductor layers in the drive transistors and switching transistors used in the light emitting pixels according to the disclosure may be, but not limited to, an oxide semiconductor material such as IGZO (In—Ga—Zn—O). A transistor whose semiconductor layer is made of an oxide semiconductor such as IGZO has low leakage current. Moreover, in the case where a transistor whose semiconductor layer is made of an oxide semiconductor such as IGZO is used as a switch, a positive threshold voltage can be used, with it being possible to suppress leakage current from the gate of the drive transistor.

Although organic EL elements are used as light emitting elements in each of the foregoing embodiments, any type of light emitting elements may be used as long as the amount of light emission changes according to current.

The display device such as an organic EL display device described above may be used as a flat panel display, and is applicable to all kinds of electronics having display devices, such as television sets, personal computers, and mobile phones.

INDUSTRIAL APPLICABILITY

The disclosure may be used in display devices, in particular the display devices of television sets and the like.

REFERENCE SIGNS LIST

1 Display device
2 Control unit
3 Scan line drive circuit
4 Power unit
5 Data line drive circuit
6 Display panel
60 Pixel circuit
61 Drive transistor
62, 63, 64 Switch
65 Enable switch
66 EL element
67 Capacitance element
68 Reference voltage power line
69 EL anode power line
70 EL cathode power line
71 Initialization power line
72 Scan line
73 Ref line
74 Init line
75 Enable line
76 Data line

The invention claimed is:

1. A power off method of a display device that includes a display panel having a plurality of pixel circuits arranged in a matrix, each of the plurality of pixel circuits including a light emitting element that emits light with luminance corresponding to an amount of current supplied, a drive transistor that supplies the current to the light emitting element, and a capacitance element that is connected to a gate of the drive transistor and holds a voltage representing the luminance, the power off method of a display device comprising:

detecting a power off operation of the display device;

setting, when the power off operation is detected, a voltage for suppressing electrical stress on the drive transistor, in the capacitance element in each of the plurality of pixel circuits; and stopping power supply to the display panel immediately after the voltage is set, wherein in the setting, a voltage equivalent to a threshold voltage of the drive transistor is set in the capacitance element in each of the plurality of pixel circuits, and wherein the power off operation is detected when a user off-activation of a power switch is detected, wherein the power off operation is also detected when an arrival of an off-time of an off timer set by a user is detected, wherein the power off operation is also detected when a lapse of a time of a non-operation duration measurement timer set by the user is detected, and wherein the power off operation is also detected when a decrease in power voltage to the display device due to a power failure is detected.

2. The power off method of a display device according to claim 1, wherein in the setting:

an initial voltage that is higher than the threshold voltage of the drive transistor and does not cause the light emitting element to emit light is held in the capacitance element in each of the plurality of pixel circuits;

the drive transistor is brought into conduction by the initial voltage;

the voltage of the capacitance element is decreased by a conduction current flowing through the drive transistor brought into conduction;

the drive transistor is brought out of conduction by the decrease of the voltage of the capacitance element; and the voltage equivalent to the threshold voltage is a voltage when the drive transistor is brought out of conduction.

3. The power off method of a display device according to claim 1, wherein in the setting, the voltage equivalent to the threshold voltage of the drive transistor is set in the capacitance element in each of the plurality of pixel circuits simultaneously.

4. A display device, comprising:

a display panel having a plurality of pixel circuits arranged in a matrix, each of the plurality of pixel circuits including a light emitting element that emits light according to an amount of current supplied, a drive transistor that supplies the current to the light emitting element, and a capacitance element that is connected to a gate of the drive transistor and holds a voltage representing luminance;

a voltage controller configured to set, when a power off operation is detected, a voltage for suppressing electrical stress on the drive transistor, in the capacitance element in each of the plurality of pixel circuits; and a power controller configured to stop power supply to the display panel immediately after the voltage controller sets the voltage, wherein the voltage controller is configured to set a voltage equivalent to a threshold voltage of the drive transistor, as the voltage for suppressing electrical stress on the drive transistor, and wherein the power off operation is detected when a user off-activation of a power switch is detected, wherein the power off operation is also detected when an arrival of an off-time of an off timer set by a user is detected, wherein the power off operation is also detected when a lapse of a time of a non-operation duration measurement timer set by the user is detected, and wherein the power off operation is also detected when a decrease in power voltage to the display device due to a power failure is detected.

* * * * *